US005431082A

United States Patent [19]

Zelverte et al.

[11] Patent Number: 5,431,082

[45] Date of Patent: Jul. 11, 1995

[54] MINESWEEPING SYSTEM AND METHOD

[75] Inventors: Joël Zelverte, La Chapelle Saint Ursin; Philippe Amberny, Savigny en Septeaine, both of France

[73] Assignee: Giat Industries, Versailles, France

[21] Appl. No.: 283,767

[22] Filed: Aug. 1, 1994

[30] Foreign Application Priority Data

Jul. 30, 1993 [FR] France ..... 93 09412

[51] Int. Cl.[6] ..... F41H 11/12

[52] U.S. Cl. ..... 89/1.13

[58] Field of Search ..... 89/1.13

[56] References Cited

U.S. PATENT DOCUMENTS

| | | | |
|---|---|---|---|
| 2,442,390 | 6/1948 | Williams | 89/1 |
| 3,771,413 | 11/1973 | Sieg et al. | 89/1.13 |
| 3,837,259 | 9/1974 | Vaughn | 89/1 M |
| 4,593,766 | 6/1986 | Gossard | 171/63 |
| 4,667,564 | 5/1987 | Schreckenberg | 89/1.13 |
| 4,909,128 | 3/1990 | Grinwald | 89/1.13 |
| 5,183,119 | 2/1993 | Wattenburg | 171/105 |

FOREIGN PATENT DOCUMENTS

| | | | |
|---|---|---|---|
| 2622162 | 12/1977 | Germany | 89/1.13 |

*Primary Examiner*—Charles T. Jordan
*Assistant Examiner*—Theresa M. Wesson
*Attorney, Agent, or Firm*—Oliff & Berridge

[57] ABSTRACT

A minesweeping system, in particular for surface mines of the pressure plate type, has a minesweeping structure pushed by a propelling device. The minesweeping structure is constituted by a deformable elongate surface with an appropriate weight per unit length to apply to the mine a sufficient continuous pressure for a sufficiently long period of time to explode the mine as the surface passes over it. This surface is constituted for example by articulated metal shoes forming a track.

24 Claims, 2 Drawing Sheets

FIG. 1
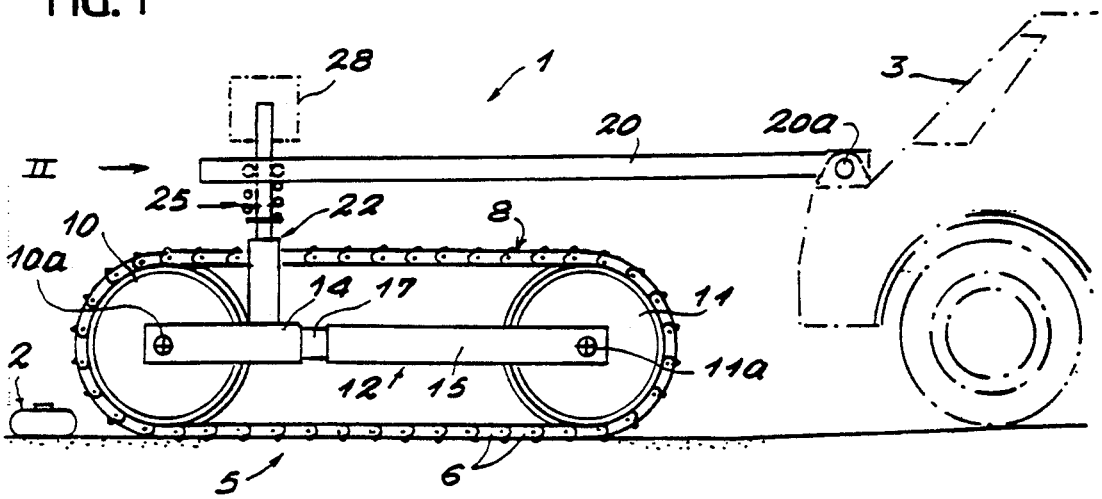
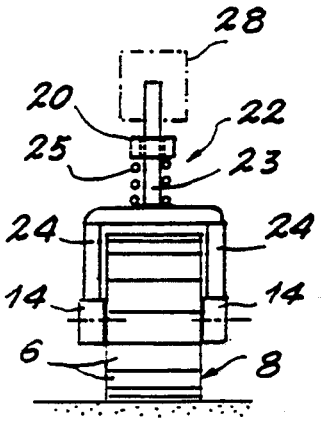
FIG. 2
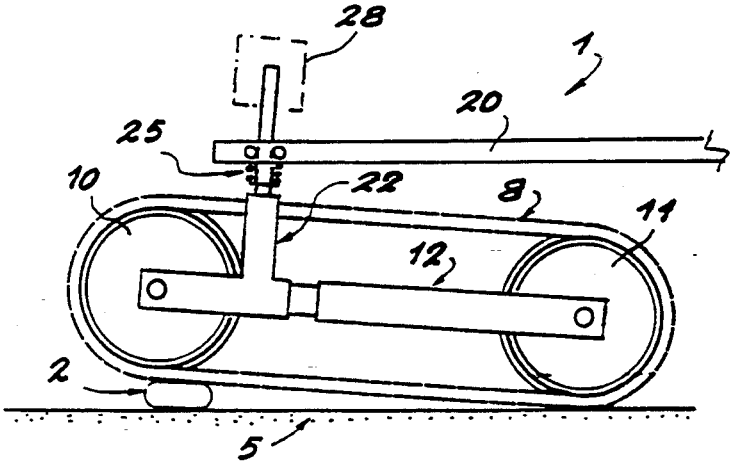
FIG. 3
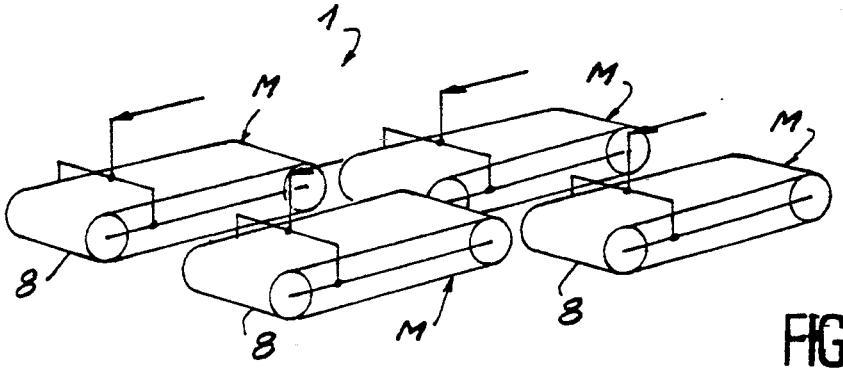
FIG. 4

MINESWEEPING SYSTEM AND METHOD

BACKGROUND

The present invention relates to a minesweeping system, in particular, for surface mines of the pressure plate type, the system having minesweeping structure pushed by a motorized vehicle, which structure is designed to come in contact with a mine resting on the ground and cause it to explode.

Minesweeping devices are generally comprised of wheels disposed in a staggered arrangement to cover a given width of terrain. Each wheel is rotationally free and rolls over the ground such that a mine should be able to explode on contact and upon the passage of a single wheel. However, a mine equipped with a pressure plate requires, for explosion, application of a pressure for a period of time that represents the pressure exerted by an infantryman walking at normal speed or by a vehicle driving at low speed, this time being estimated at approximately 0.4 second. As a result, the effectiveness of such a wheel-mounted minesweeping system is governed by the minesweeping rate, requiring that the time taken for a single wheel to pass over a mine be long enough to explode the mine. This rate being of course a function of the wheel diameter.

Moreover, another drawback of such a wheel-mounted minesweeping system is that relatively long intervals are required to replace wheel elements that have degraded following explosion of a mine.

SUMMARY OF THE INVENTION

A goal of the invention is to remedy the aforementioned drawbacks by a minesweeping system able to exert a sufficient pressure on a mine for a sufficiently long period of time, increasing the minesweeping rake and decreasing the downtime needed for repairing elements degraded as a result of mine explosions.

For this purpose, the invention proposes a minesweeping system of the aforesaid type including a deformable elongate surface with an appropriate weight per unit length to apply to the mine a sufficient continuous pressure for a sufficiently long period of time to explode the mine as the surface passes over it.

According to another characteristic of the invention, the deformable elongate surface is made of metal and composed of articulated shoes.

A minesweeping system according to the invention provides many advantages, including in particular:

- the possibility of applying a sufficient pressure to a mine and for a sufficiently long period of time to explode the mine,
- increasing the rate of minesweeping,
- improved protection of the vehicle,
- an articulated surface area which conforms to the shape of the land, and
- reduction of vehicle downtime for repairing damage caused by explosion of a mine.

BRIEF DESCRIPTION OF THE DRAWINGS

Other advantages, characteristics, and details of the invention will emerge from the explanatory description hereinbelow with reference to the attached drawings provided solely as an example, wherein:

FIG. 1 is a diagram illustrating the structure of a minesweeping system according to a first embodiment of the invention:

FIG. 2 is a partial view along arrow II in FIG. 1:

FIG. 3 is a view similar to that of FIG. 1 illustrating the operating principle of the first embodiment of the invention:

FIG. 4 is a schematic perspective view illustrating an alternative to the first embodiment of the invention illustrated in FIG. 1:

DETAILED DESCRIPTION OF PREFERRED EMBODIMENTS

Figure 5:
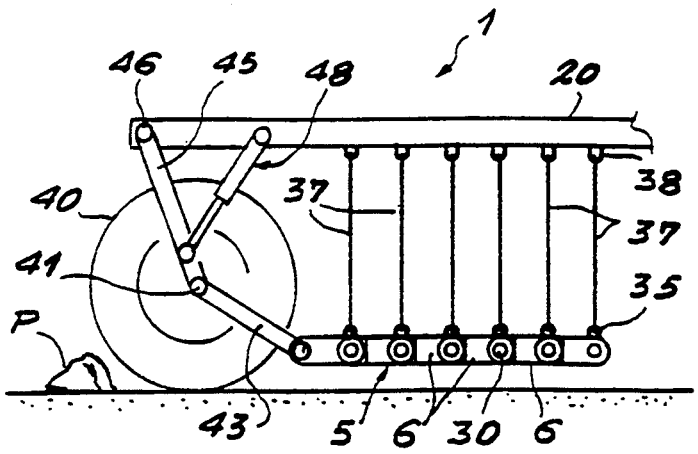
FIG. 5 is a diagram to illustrate a minesweeping system according to a second embodiment of the invention.

According to a first embodiment of the invention, the articulated shoes form a track running around two wheels, the rotating axles of these two wheels being supported rotationally by a chassis connected to the vehicle by a push bar. Advantageously, the chassis supporting the track wheels has a device for adjusting the tension of the track. In this first embodiment, the pressure exerted on a mine is in total equal to the weight of the chassis supporting the track, which weight can be increased by additional loads if necessary.

According to a second embodiment of the invention, the shoes are suspended at a low height off the ground so that they come successively in contact with a mine resting on the ground, whereby the pressure exerted on the mine is then substantially equal to the weight of a shoe.

According to another characteristic of the second embodiment, the shoes are suspended from a support connected with the vehicle by flexible cables allowing the surface covered by the shoes to deform when in contact with a mine and/or an obstacle such as a rock for example. Advantageously, the suspended shoes are preceded by a freely rotationally mounted wheel whose axle is supported by the support or push bar on which the shoes are suspended. Thus, the wheel that first comes in contact with a mine can immobilize the mine by driving it slightly into the ground, in the case of loose ground, and prevent the mine from being shifted by the suspended shoes.

In general, the length of the minesweeping surface area formed by the shoes of the track or by the suspended shoes is chosen so as to optimize minesweeping speed without damaging the effectiveness of the minesweeping system. The damage occasioned by explosion of a mine as the minesweeping surface passes is usually limited to replacing a few consecutive shoes on the track (first embodiment) or a few consecutive shoes suspended from cables (second embodiment), which operations do not require excessive downtime.

In general, the minesweeping system according to the invention comprises at least one module constituted by the shoes of a track or by shoes suspended above the ground, but it is possible to conceive of a minesweeping system with several modules disposed in a staggered arrangement to ensure a minesweeping operation over a wider strip of land.

A minesweeping system 1 according to the embodiments of the figures is designed, in particular, to sweep a terrain in which mines 2 are located, particularly surface mines of the pressure plate type.

As illustrated in FIG. 1, minesweeping system 1 is comprised of at least one module pushed by a motorized vehicle 3. The module supports the minesweeping means which are constituted by a deformable elongate surface 5 having an appropriate weight per unit length to apply, to a mine 2, a sufficient pressure for a sufficiently long time to explode mine 2 as surface 5 passes.

In general, surface 5 is made of metal and is constituted by shoes 6 that are articulated to allow surface 5 to deform.

According to a first embodiment illustrated in FIG. 1, shoes 6 form a track 8 running around two wheels 10 and 11 which are freely rotationally mounted around two axles 10*a* and 11*a*, respectively.

The two axles 10*a* and 11*a* are supported by a chassis 12 connected to vehicle 3. Chassis 12 has for example, on each side of track 8, two rods 14 and 15 assembled telescopically to each other by means of a linking device 17. This device 17 allows the distance between the two wheels 10 and 11 to be adjusted to adjust the tension of track 8.

The minesweeping module formed by track 8 is pushed by drive vehicle 3 by a rigid linking structure comprising a push bar 20 which extends essentially parallel to the ground and which is articulated at 20*a* on the front of the chassis of vehicle 3, and a fork 22 mounted between push bar 20 and track 8. The fork has a central arm 23, and extending from one end of the central arm 23 are two parallel lateral arms 24, spaced apart by a length slightly greater than that of track 8.

The two arms 24 of fork 22 (FIG. 2) straddle track 8 and are attached respectively to the two rods 14 disposed on either side of track 8. Central arm 23 is made integral with push bar 20, with interposition of a damping device 25 constituted by a spring for example.

In operation, as shown schematically in FIG. 3, front wheel 10 passes over a mine 2 resting on the ground, and shoes 6 of track 8 apply, one by one, a pressure on mine 2. The length of track 8 and the speed of vehicle 3 are such that the pressure applied to mine 2 by shoes 6 is sufficient, and exerted for a sufficient time, for a surface mine of the pressure plate type to explode as track 8 pushed by vehicle 3 passes over it.

Following explosion of mine 2, the damage occasioned is generally confined to replacing one or two shoes 6.

The pressure exerted by track 8 on mine 2 is overall equal to the weight of chassis 12 which supports track 8, but this force can be increased by adding additional loads 28. Such loads 28 are, for example, supported by push bar 20 in the vicinity of fork 22 which connects bar 20 to chassis 12 of track 8.

With reference to FIG. 4, a minesweeping system is represented comprising several modules M, each module having a track 8. The modules are, for example, divided into two rows with tracks 8 in a staggered arrangement so that a wider strip of land can be swept.

According to a second embodiment illustrated in FIGS. 5 to 9, shoes 6 are suspended at a low height above the ground so that they come successively in contact with a mine 2 resting on the ground.

Figure 6:
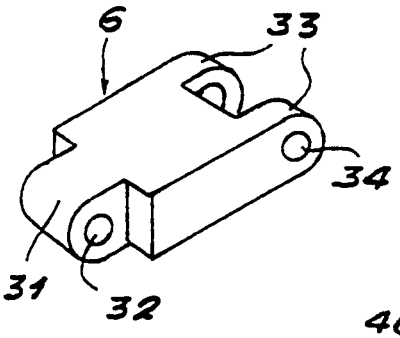
FIG. 6 is a detailed view of a minesweeping element.

With reference to FIG. 5, shoes 6 are mounted end to end, articulated two by two by a pin 30 for example. As can be seen in FIG. 6, each shoe 6 is extended at one end by a central extension 31 provided with a hole 32. At its opposite end, shoe 6 is extended by two lugs 33 spaced apart from each other and provided with two axially aligned holes 34. The distance between the two lugs 33 allows an extension 31 of another shoe 6 to be freely engaged in order to align holes 34 of the two lugs 33 of a first shoe with hole 32 of the extension 31 of a second shoe in order to engage a pin 30 providing an articulated link between the two shoes 6.

Each shoe 6 also has a mounting lug 35 located for example at its extension 31. This lug 35 serves to attach one end of a flexible linking cable 37, the other end of which is attached to a lug 38 supported by a push bar 20 connected to vehicle 3.

Push bar 20 supports, in front of shoes 6, a wheel 40 which rests on the ground.

One end of an oscillating arm 43 is mounted on rotating axle 41 of wheel 40 while its other end is connected in an articulated manner by a pin 30 for example to first shoe 6 or the frontmost shoe. One end of a second oscillating arm 45 is mounted on rotating axle 41 of wheel 40, while its other end is articulated by means of a shaft 46 to the push bar. A damping device 48 is mounted between push bar 20 and second oscillating arm 45, in the vicinity of the end thereof which is adjacent rotating axle 41 of wheel 40.

Figure 7:
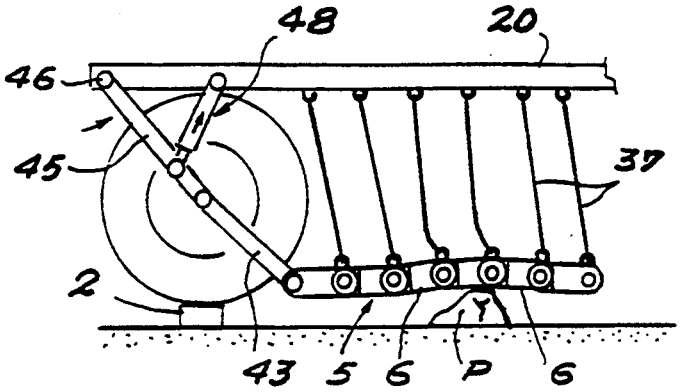
FIGS. 7 and 8 are views similar to that of FIG. 1 to illustrate the operating principle of the second embodiment of the invention.
Figure 8:
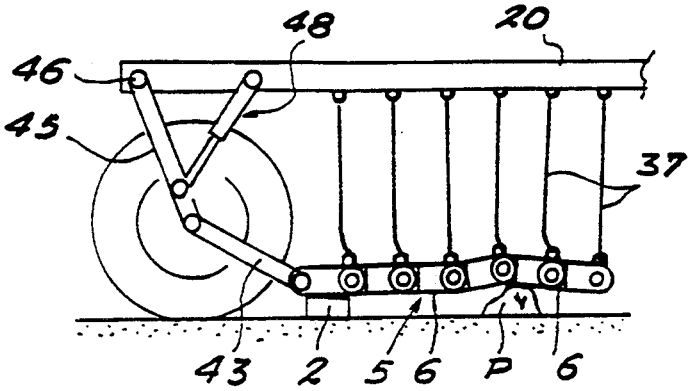

In operation, as shown in FIGS. 7 and 8, wheel 40 runs over a mine 2 resting on the ground with simultaneous deformation of damping device 48, and mine 2 then comes successively in contact with each of shoes 6 located at the rear of wheel 40. With a sufficient number of shoes, it is possible to exert on mine 2 a sufficient pressure lasting a sufficiently long period of time for mine 2 to explode as one of shoes 6 passes over it. In general, the pressure exerted on mine 2 is equal to the weight of each shoe 6. Suspension of each shoe 6 by a cable 37 allows minesweeping surface 5 to deform as it passes over a foreign body such as a rock P and conform to its shape without interfering with the operation of the minesweeping system.

According to this second embodiment, wheel 40 located in front of suspended shoes 6 can, when the ground to be swept is loose, dig in and immobilize mine 2 in the ground to prevent it from being shifted by shoes 6.

As in the case of the first embodiment, it is possible to create a minesweeping system having several modules divided into several rows with the shoes in a staggered arrangement, each module having a front wheel 40 and several shoes 6 rearward thereof and located at a distance from the ground.

Of course, the invention is not confined to the two above embodiments which were described only as examples. In particular, the linking devices between a minesweeping module constituted either by a track 8 or by an assembly composed of a front wheel 40 followed by suspended shoes 6 may have more-complex or less-complex structures, particularly as a function of the number of modules used. Finally, it should also be noted that a minesweeping system according to the invention can, because of its metal structure, also explode mines of a different type, as for example magnetic, seismic, or acoustic mines.

What is claimed is:

1. A minesweeping system adapted to be pushed by a motorized vehicle and to come in contact with a mine resting on the ground and cause it to explode, comprising a deformable elongate surface with a weight per unit length sufficient to apply to the mine a sufficient continuous pressure for a sufficiently long period of time to explode the mine as said surface passes over it.

2. A minesweeping system according to claim 1, wherein the deformable elongate surface is made of metal and is comprised of a plurality of articulated shoes.

3. A minesweeping system according to claim 2, wherein said shoes are connected end to end to form a track, said track being disposed around two wheels.

4. A minesweeping system according to claim 3, wherein the two wheels are freely rotationally mounted around two corresponding axles, said axles being supported by a chassis connectable to a motorized vehicle.

5. A minesweeping system according to claim 4, wherein the chassis is connectable to a motorized vehicle by a linking member for propelling the chassis.

6. A minesweeping system according to claim 4, wherein the chassis comprises a device for adjusting the tension of the track.

7. A minesweeping system according to claim 6, wherein the device for adjusting the tension of the track is a telescoping joint.

8. A minesweeping system according to claim 2, wherein said shoes are suspended from a support connectable to a motorized vehicle.

9. A minesweeping system according to claim 8, wherein the shoes are suspended from the support by a plurality of flexible cables.

10. A minesweeping system according to claim 9, wherein consecutive shoes are connected to each other by articulation joints, at least one of the plurality of cables being provided at each of said articulation joints.

11. A minesweeping system according to claim 8, wherein the support comprises a push bar.

12. A minesweeping system according to claim 11, further comprising a free wheel configured to rest on the ground in front of the elongate surface, the wheel being rotationally supported by the push bar.

13. A minesweeping system designed to come in contact with a mine resting on the ground and cause it to explode, comprising at least two pairs of wheels and at least two deformable elongate surfaces comprised of a plurality of articulated shoes connected end to end to form a track, each track disposed around a pair of wheels, each of the elongate surfaces having a weight per unit length sufficient to apply to the mine a sufficient continuous pressure for a sufficiently long period of time to explode the mine as said elongate surface passes over it, wherein the at least two elongate surfaces are disposed in a staggered arrangement.

14. A minesweeping system, designed to come in contact with a mine resting on the ground and cause it to explode, comprising at least two deformable elongate surfaces comprised of a plurality of shoes, each of the elongate surfaces having a weight per unit length sufficient to apply to a mine a sufficient continuous pressure for a sufficiently long period of time to explode the mine as said elongate surface passes over it, wherein said shoes are suspended from at least one support rod connectable to a motorized vehicle.

15. A minesweeping system according to claim 14, wherein said shoes are suspended by a plurality of support wires, each support wire having a first end connected to a support rod and a second end connected to one of the shoes, the support wires suspending the at least two elongate surfaces a predetermined distance above the ground.

16. A non-self propelled minesweeping system adapted to be propelled onto a surface mine by a separate propelling vehicle to cause the surface mine to explode, comprising:

at least one deformable elongate surface having a weight per unit length sufficient to cause a surface mine to explode when the at least one elongate surface is propelled onto the surface mine and remains on top of the surface mine for a sufficient period of time;

means for supporting the at least one elongate surface; and means for linking the minesweeping system to a separate propelling vehicle.

17. A minesweeping system according to claim 16, wherein the at least one elongate surface comprises a plurality of shoes.

18. A minesweeping system according to claim 17, wherein the means for supporting the at least one elongate surface comprises:

a chassis comprising:

first and second axles, first and second side rails connecting the first and second axles, and first and second wheels rotationally mounted on the first and second axles, respectively, wherein the shoes are connected end to end to form an endless track that runs around the first and second wheels.

19. A minesweeping system according to claim 18, wherein the means for linking the minesweeping system to a separate propelling vehicle comprises:

a fork having an upper end and a lower end, the lower end comprising two arms connected to the chassis; and a linking member having a first end connected to the upper end of the fork, and a second end that is connectable to a propelling vehicle, wherein a propelling force may be applied to the chassis by the propelling vehicle through the linking member and the fork.

20. A minesweeping system according to claim 17, wherein the means for supporting the at least one elongate surface comprises:

a support rod having a first end connectable to a propelling device; and a plurality of support wires, each support wire having a first end connected to the support rod and a second end connected to one of said shoes, the support wires suspending the at least one elongate surface a predetermined distance above the ground.

21. A minesweeping system according to claim 20, wherein the shoes are connected end to end by articulation joints, and wherein the second ends of the support wires are connected to the shoes adjacent the articulation joints.

22. A minesweeping system according to claim 20, further comprising a wheel rotationally mounted on a second end of the support rod for supporting the second end of the support rod above the ground.

23. A method of minesweeping, comprising the steps of:

providing at least one deformable elongate surface that is propellable by a separate propelling device, each of the at least one elongate surfaces being comprised of a plurality of articulated shoes and having a weight per unit length sufficient to cause a surface mine to explode when the at least one elongate surface is propelled onto a surface mine and remains on top of the surface mine for a sufficient period of time; and propelling the at least one elongate surface through a minefield with a separate propelling device so that the at least one elongate surface is propelled onto a surface mine in the minefield and remains on top of the mine for a sufficient period of time to cause the mine to explode.

24. A method of minesweeping, comprising the steps of:

providing at least two deformable elongate surfaces disposed in a staggered formation and connected so as to be propellable by a separate propelling device, each of the elongate surfaces being comprised of a plurality of articulated shoes and having a weight per unit length sufficient to cause a surface mine to explode when the elongate surface is propelled onto a surface mine and remains on top of the surface mine for a sufficient period of time; and propelling the at least two elongate surfaces through a minefield with a separate propelling device so that at least one elongate surface is propelled onto a surface mine in the minefield and remains on top of the mine for a sufficient period of time to cause the mine to explode.

* * * * *